US006958729B1

(12) United States Patent
Metz

(10) Patent No.: US 6,958,729 B1
(45) Date of Patent: Oct. 25, 2005

(54) PHASED ARRAY METAMATERIAL ANTENNA SYSTEM

(75) Inventor: Carsten Metz, Township of Chatham, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 10/795,607

(22) Filed: Mar. 8, 2004

Related U.S. Application Data

(60) Provisional application No. 60/550,473, filed on Mar. 5, 2004.

(51) Int. Cl.[7] ..... H01Q 1/38
(52) U.S. Cl. ..... 343/700 MS; 343/753; 343/754
(58) Field of Search ..... 343/700 MS, 753, 343/754, 853, 116, 156

(56) References Cited

U.S. PATENT DOCUMENTS 6,750,820 B2 * 6/2004 Killen et al. ..... 343/700 MS
6,753,814 B2 * 6/2004 Killen et al. ..... 343/700 MS
6,859,114 B2 * 2/2005 Eleftheriades et al. ..... 333/156

OTHER PUBLICATIONS

Shelby, R.A., Smith, D.R., Schultz, S., *Experimental Verification of a Negative Index of Refraction*, Science, vol. 292, Apr. 6, 2001, pp. 77-79.

Caloz, C., Sanada, A. Itoh, T., *Microwave Circuits based in Negative Refractive Index Material Structures*, 33rd European Microwave Conference, Munich, 2003, pp. 105-109.

Caloz, C., Itoh, T., *Positive/Negative Refractive Index Anisotropic 2-D Metamaterials*, IEEE Microwave And Wireless Components Letters, vol. 13, No. 12, Dec., 2003, pp. 547-549.

Caloz, C., Sanada, A., Liu, L., Itoh, T., *A Broadband Left-Handed (LH) Coupled-Line Backward Coupler with Arbitrary Coupling Level*, IEEE MTT-S Digest, 2003, pp. 317-320.

Caloz, C., Itoh, T., *A Novel Mixed Conventional Microstrip and Composite Right/Left-Handed Backward-Wave Directional Coupler With Broadband and Tight Coupling Characteristics*, IEEE Microwave And Wireless Components Letters, vol. 14, No. 1, Jan. 2004, pp. 31-33.

Caloz, C., Itoh, T., *Invited—Novel Microwave Devices and Structures Based on the Transmission Line Approach of Meta-Materials*, Focused Session Paper, IEEE MTT-S Digest, 2003, pp. 195-198.

Wiltshire, M.C.K., *Bending Light the Wrong Way*, Science Magazine, vol. 292, No. 5514, Issue of Apr. 6, 2001, pp. 60-61.

(Continued)

*Primary Examiner*—Hoang V. Nguyen
(74) *Attorney, Agent, or Firm*—David W. Herring

(57) ABSTRACT

An efficient, low-loss, low sidelobe, high dynamic range phased-array radar antenna system is disclosed that uses metamaterials, which are manmade composite materials having a negative index of refraction, to create a biconcave lens architecture (instead of the aforementioned biconvex lens) for focusing the microwaves transmitted by the antenna. Accordingly, the sidelobes of the antenna are reduced. Attenuation across microstrip transmission lines may be reduced by using low loss transmission lines that are suspended above a ground plane a predetermined distance in a way such they are not in contact with a solid substrate. By suspending the microstrip transmission lines in this manner, dielectric signal loss is reduced significantly, thus resulting in a less-attenuated signal at its destination.

11 Claims, 5 Drawing Sheets

OTHER PUBLICATIONS

Markos, P., Soukoulis, C. M., *Structures with Negative Index of Refraction*, Published online Dec. 3, 2002.
Smith, D.R., Padilla, W.J., Vier, D.C., Nemat-Nasser, S. C., Schultz, S., *Composite Medium with Simultaneously Negative Permeability and Permittivity*, Physical Review Letters, vol. 84, No. 18, May 1, 2000, pp. 4184-4187.
Sievenpiper, D.F., Yablonovitch, E., Winn, J. N., Fan, S., Villeneuve, P.R., Joannopoulos, J.D., 3D *Metallo-Dielectric Photonic Crystals with Strong Capacitive Coupling Between Metallic Islands*, Physical Review Letters, vol. 80, No. 13, Mar. 30, 1998, pp. 2829-2832.
Pendry, J.B., Holden, A.J., Robbins, D.J., Stewart, W.J., *Magnetism from Conductors and Enhanced Nonlinear Phenomena*, IEEE Transactions on Microwave Theory and Techniques, vol. 47, No. 11, Nov. 11, 1999, pp. 2075-2084.
Smith, D.R., Kroll, N., *Negative Refractive Index in Left-Handed Materials, Physical Review Letters*, vol. 85, No. 14, Oct. 2, 2000, pp. 2933-2936.
Pendry, J.B., *Negative Refraction Makes a Perpect Lens*, Physical Review Letters, vol. 85, No. 18, Oct. 30, 2000, pp. 3966-3969.
Eleftheriades, G.V., Siddiqui, O., lyer, A.K., *Transmission Line Models For Negative Refractive Index Media and Associated Implementations Without Excess Resonators*, IEEE Microwave and Wireless Components Letters, vol. 13, No. 2, Feb. 2003, pp. 51-53.
Grbic, A., Eleftheriades, G.V., *Experimental verification of backward-wave radiation from a negative refractive index metamaterial*, Journal of Applied Physics, vol. 92, No. 10, Nov. 15, 2002, pp. 5930-5935.
Shelby. R.A., Smith, D.R., Nemat-Nasser, S.C., Schultz, S., *Microwave transmission through a two-dimensional, isotropic, left-handed metamaterial*, Applied Physics Letters, vol. 78, No. 4, Jan. 22, 2001, pp. 489-491.
Eleftheriades, G.V., Iyer, A., Kremer, P.C., *Planar Negative Refractive Index Media Using Periodically L-C Loaded Transmission Lines*, IEEE Transactions on Microwave Theory and Techniques, vol. 50, No. 12, Dec. 2002, pp. 2702-2712.
Pendry, J.B., Holden, A.J., Stewart, W.J., Youngs, I., Extremely Low Frequency Plasmons in Metallic Mesostructures, Physical Review Letters, vol. 76, No. 25, Jun. 17, 1996, pp. 4773-4776.
Kolinko, P., Smith, D.R., *Numerical study of electromagnetic waves interacting with negative index materials*, Optics Express, vol. 11, No. 7, Apr. 7, 2003, pp. 640-648.
Johnson, C., 'Metamaterial'holds promise for antennas, optics, EE Times, May 11, 2001.
Robling, H. R., Hoss, A., Lubbert, U., Schiementz, M., *Multistatic Radar Principles For Automotive RadarNet Applications*, Technical Univerity Hamburg-Harburg, Dept. of Telecommunications.
Skolnik, M., *Opportunities in radar-2002*, Electronics & Communication Engineering Journal, Dec. 2002, pp. 263-272.
Kaleja, M., Biebl, *Active Integrated Antennas For Automotive Applications*, IEEE Seminar—Antennas for Automotive Applications, Mar. 2000.
Spencer, D.G., *Novel Millimeter ACC Antenna Feed*, IEEE Seminar—Antennas for Automotive Applications, Mar. 2000.
Hoare, E.G., Hill, R., *System Requirements for Automotive Radar Antennas*, IEEE Seminar—Antennas for Automotive Applications, Mar. 2000.
Mias, C., Tsakonas, C., Prountzos, N., Koutsogeorgis, D.C., Liew, S.C., Oswald, C., Ranson R., Cranton, W.M., Thomas, C.B., *Optically Transparent Microstrip Antennas*, IEEE Seminar—Antennas for Automotive Applications, Mar. 2000.
Langley, R.J., Batchelor, J.C., *Hidden Antennas for vehicles*, Electronics & Communications Engineering Journal, Dec. 2002, pp. 253-262.
Honma, S., Uehara, N., *Millimeter- Wave Radar Technology for Automotive Application*, Mitsubishi Electric Advance, Jun. 2001, pp. 11-13.
Kolak, F., Eswarappa, C., *A Low Profile 77 GHz Three Beam Antenna for Automotive Radar*, IEEE, 2001.

* cited by examiner

PHASED ARRAY METAMATERIAL ANTENNA SYSTEM

CROSS-REFERENCE TO RELATED APPLICATIONS

This application claims priority to U.S. Provisional Patent Application, Ser. No. 60/550,473, entitled Phased Array Metamaterial Antenna System, filed Mar. 5, 2004.

FIELD OF THE INVENTION

The present invention relates to phased array antenna systems and, more particularly, to phased array antenna systems useful in automotive radar applications.

BACKGROUND OF THE INVENTION

Phased array systems and antennas for use in such systems are well known in, for example, telecommunications and radar applications. Such systems generally employ fixed, planar arrays of individual transmit and receive elements. When receiving electromagnetic (EM) signals, such as a communication signal or the return signal in a radar system, phased array systems receive signals at the individual elements and coherently reassemble the signals over the entire array by compensating for the relative phases and time delays between the elements. When transmitting signals, beams are electronically steered by delaying the excitation of selected individual radiating elements. For relatively small antennas, adequate delays of the individual elements can be provided by adjusting the phase of the excitation signals supplied to the elements.

Traditional phased-array antenna systems used in such applications were expensive to manufacture, were relatively large and bulky, and the performance was less than desirable due to, for example, relatively poor performance of monolithic microwave integrated circuits (MMICs) of the transceiver section of the antenna system. For example, such MMICs typically resulted in significant undesirable sidelobes which limited the usefulness of antennas using such circuits. Recent attempts at such antenna systems have included printing antenna system elements, such as signal traces and patch antennas, on a circuit board using well-known lithography techniques. Such antenna systems solve one problem in that they are smaller and relatively inexpensive to manufacture and, therefore, have been used increasingly in new applications. One such application is in adaptive cruise control systems in trucks, automobiles and other such vehicles. Such cruise control systems are able to reduce or increase the speed of the vehicle in order to maintain a predetermined distance between the vehicle and other traffic. Radar systems in vehicles are potentially also useful in such applications as collision avoidance and warning.

SUMMARY OF THE INVENTION

The present inventor has realized that, while the size and cost of in-vehicle phased array antenna systems has improved, due in part to the lithographic processes used to manufacture modern antenna systems, even the improved antenna systems are limited in certain regards. For example, recent attempts of implementing in-vehicle radar have focused on the 76–77 GHz frequency range and recent data communications attempts have been made in the 71–76 GHz and the 81–86 GHz frequency range. However, at such frequencies, antenna systems with lithographically-printed microstrip transmission lines experience a high degree of signal attenuation. Additionally, such printed antenna systems have relied on a signal-feed/delay line architecture that resulted in a biconvex, or Fresnel, lens for focusing the microwaves. The use of such lens architectures resulted in microwave radiation patterns having poor sidelobe performance due to signal attenuation of electromagnetic energy as it passed through the lens. Specifically, the signal passing through the center portion of the lens was attenuated to a greater degree than the signal passing through the edges of the lens, thus resulting in significant sidelobes. While signal delay lines in the lens portion of the system could reduce the sidelobes and, as a result, increase the amplitude performance of the phased array system, this was also limited in its usefulness because, by implementing such delay lines, the operating bandwidth of the phased-array system was reduced.

Therefore, the present inventor has invented an efficient, low-loss, low sidelobe, high dynamic range phased-array radar antenna system that essentially solves the aforementioned problems. In one embodiment, the present invention uses metamaterials, which are manmade composite materials having a negative index of refraction, to create a biconcave lens architecture (instead of the aforementioned biconvex lens) for focusing the microwaves transmitted by the antenna. Accordingly, a signal passing through the center of the lens is attenuated to a lesser degree relative to the edges of the lens, thus significantly reducing the amplitude of the sidelobes of the antenna while, at the same time, retaining a relatively wide useful bandwidth.

In another embodiment, attenuation across microstrip transmission lines is reduced by using low loss transmission lines that are suspended above a ground plane a predetermined distance in a way such they are not in contact with a solid substrate. By suspending the microstrip transmission lines in this manner, dielectric signal loss is reduced significantly, thus resulting in a less-attenuated signal at its destination.

DETAILED DESCRIPTION OF THE INVENTION

Figure 1:
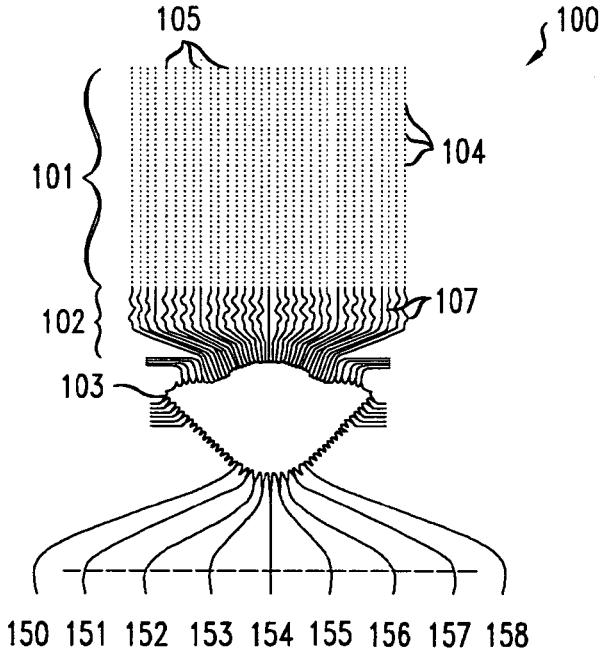
FIG. 1 (PRIOR ART)
FIG. 1 shows a prior art monolithic microwave integrated circuit phased-array antenna system.

FIG. 1 shows one illustrative, relatively low-cost prior art antenna system potentially useful for telecommunications and in-vehicle radar uses. Specifically, FIG. 1 shows a monolithic microwave integrated circuit (MMIC) phased array antenna system 100 which has antenna 101, lens portion 102, waveguide 103 and signal input lines 150–158. Antenna 101 has an array of antenna elements 101 wherein the individual elements 104 of each column 105 are electrically connected to each other. The individual columns 105 are, for example, lithographically printed microstrip lines with printed antenna patches disposed periodically along the microstrip lines. Each column 105 of antenna elements 104 is connected to one of delay lines 107 which are suitable for use as waveguides for electromagnetic signals. Delay lines 107 are, for example, microstrip lines lithographically printed on a suitable substrate. One or more electronic components, such as amplifiers, may be disposed along each of the delay lines 107. Delay lines 107 form lens 102 which is an electromagnetic lens that is used to delay and/or amplify the individual signals traveling across each delay line. Such delay lines are used in order to compensate for the aforementioned poor sidelobe performance of traditional Fresnel or biconvex lenses. As is well known, such delays serve to excite the individual antenna elements 104 at desired times relative to the other antenna elements in antenna 101 to steer and focus the radio frequency beams produced by antenna 101. However, as one skilled in the art will recognize, delay lines 107 also reduce the useful bandwidth of the phased array antenna system.

Waveguide 103 is, illustratively, a parallel plate wave guide printed lithographically on a suitable dielectric substrate. Such lithographic processes are well known in the art. Waveguide 103 functions to receive signals from any of signal input lines 150–158 and to guide those signals in a predetermined fashion to the individual delay lines 107 of lens 102. Signal input lines 150–158 are, for example, lines connected to a radar signal generating and processing system.

Figure 2:
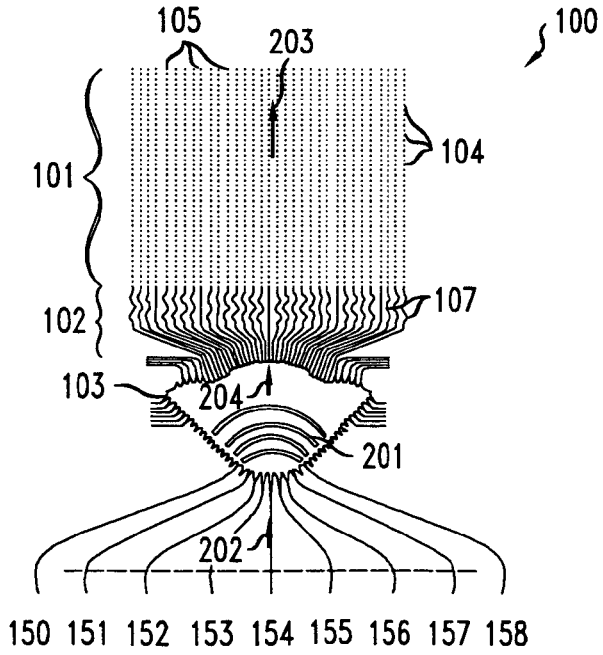
FIG. 2 (PRIOR ART)
FIG. 2 shows how the antenna system of FIG. 1 can be used to transmit an electromagnetic signal.

FIG. 2 shows how waveguide 103 functions to guide signals to delay lines 107. Specifically, when the radar generating and processing system connected to signal input lines 150–158 generates a radar signal 203 for transmission, it transmits the signal across one or more of the input lines 150–158, here, illustratively, input signal line 154. When signal 202 reaches waveguide 103, wavefront 201 spreads and propagates across the wave guide in direction 204 toward delay lines 107/lens 102. Thus, when wavefront 201 reaches the delay lines 107, the signal will enter each delay line at substantially the same time with substantially the same phase. In the embodiment of FIG. 2, when a signal is transmitted across signal line 154, the transmitted beam 203 is perpendicular to the face of antenna 101. The lengths of delay lines 107 are chosen in a way such that sidelobes are reduced (relative to a Fresnel or biconvex lens without such lines) and a desirable beam amplitude profile is achieved.

Figure 3A:
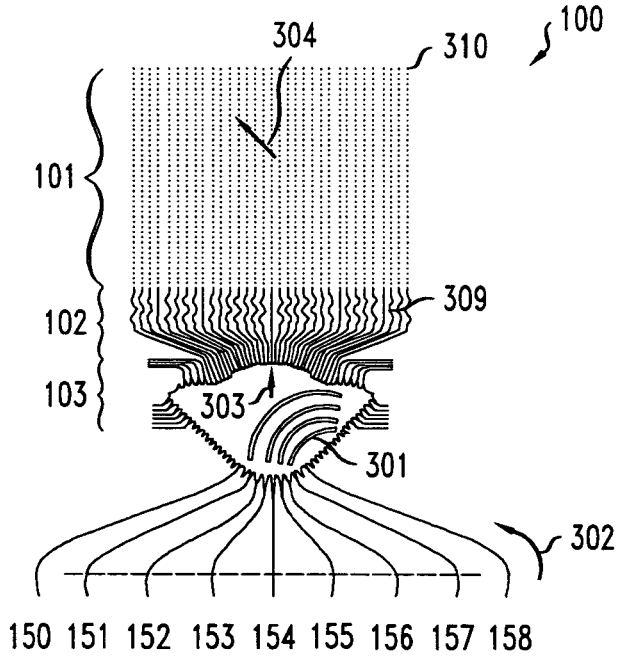
FIG. 3A (PRIOR ART)
FIGS. 3A and 3B show how an electromagnetic signal radiated by the system of FIG. 1 can be steered in different directions by selecting an appropriate signal input line.
Figure 3B:
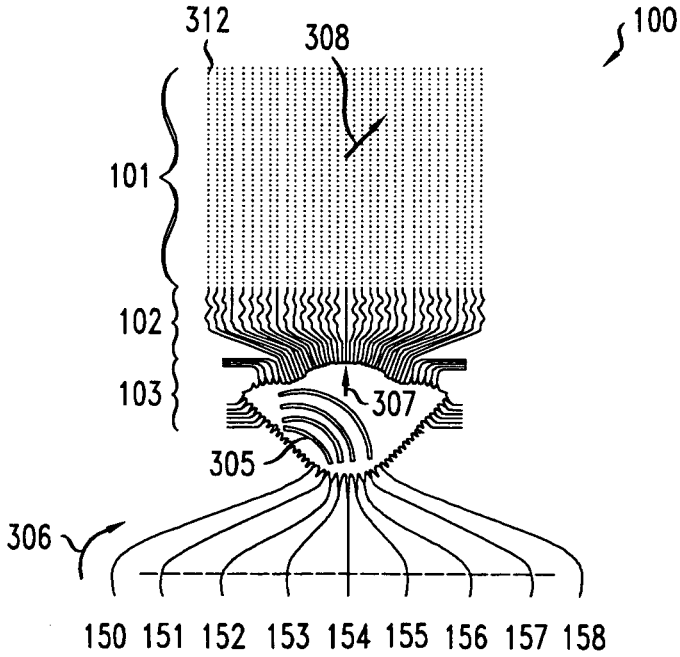
FIG. 3B (PRIOR ART)

It will be apparent to one skilled in the art that, in order to steer and focus the beam in the correct direction, the radar signal generating and processing system can transmit the signal across a different one or more of the signal input lines 150–158. For example, referring to FIG. 3A, if signal 302 is introduced to signal input line 158, when it reaches waveguide 103 wavefront 301 will be created traveling in direction 303 across the waveguide. The signal will first reach the delay line 309 corresponding to column 310 of individual elements. The signal will progressively travel across the waveguide sequentially reaching delay lines in the plurality of delay lines 102 with a slightly delayed phase relative to the signal traveling across delay line 309. As a result, it will be clear to one skilled in the art that the signal transmitted by antenna 101 will be steered in, for example, direction 304. Likewise, referring to FIG. 3B, by introducing a signal into signal input line 150, wave front 305 will travel across the waveguide 103 in direction 307, first reaching delay line 311 corresponding to column 312 of antenna elements. Accordingly, the signal transmitted by the antenna is steered in, for example, direction 308.

While the MMIC prior art antenna structures of FIGS. 1, 2, 3A and 3B are useful in many regards, they are limited in certain respects. For example, as discussed previously, delay lines 107 function to achieve a desirable signal amplitude profile with low sidelobes for a beam transmitted by antenna 101. However, MMIC antennas using a lens structure such as lens structure 102 in FIG. 1 can be relatively poor performing in terms of useable bandwidth and undesirably high sidelobes may still result.

Instead of using a biconvex lens structure, therefore, the present inventor has recognized that it would be desirable to use a biconcave lens structure that would result in lower attenuation at the center of the lens than at the edges and, as a result, result in a desirable amplitude profile of the transmitted beam without using bandwidth-limiting delay lines. However, to date, such a concave lens architecture has been difficult to achieve with conventional materials because naturally-occurring materials typically have a positive index of refraction and, hence, a biconcave lens made of such material would scatter, and not focus, light. However, recent material advances in composite structures known as metamaterials has introduced new physical structures with unique properties. The present inventor has realized that, by integrating metamaterials into the delay lines 107 of the lens portion 102 of FIG. 1, a biconcave lens structure can be achieved.

A great deal of recent research has been accomplished on the manufacture, properties and uses of metamaterials. Metamaterials, as used herein, are man-made composite structures that are characterized by a negative permittivity and a negative permeability at least across a portion of the electromagnetic frequency spectrum. Accordingly, the refractive index of a metamaterial is also negative across that portion of the spectrum. In practical terms, materials possessing such a negative index of refraction are capable of refracting propagating electromagnetic waves incident upon the metamaterial in an opposite direction compared to if the wave was incident upon a material having a positive index of refraction. If the wavelength of the electromagnetic energy is relatively large compared to the individual structure elements of the metamaterial, then the electromagnetic energy will respond as if the metamaterial is actually a homogeneous material.

Figure 4A:
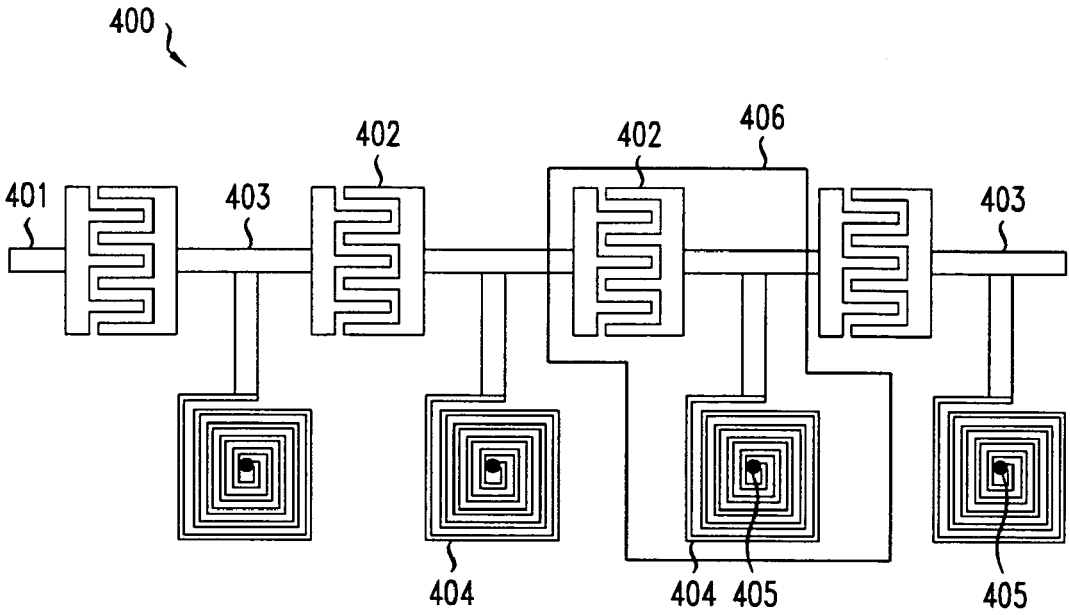
FIGS. 4A and 4B show illustrative metamaterials useful in the electromagnetic lens portion of the system of FIG. 1.
Figure 4B:
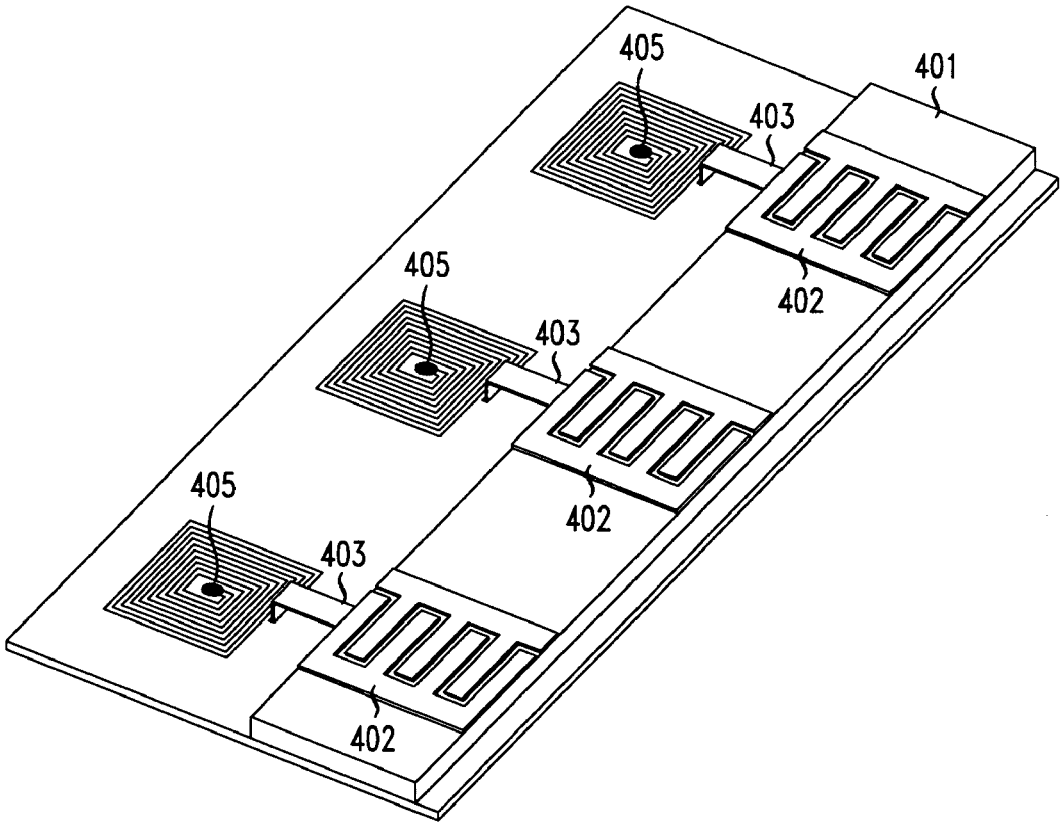

FIGS. 4A and 4B show a top view and a three dimensional view of illustrative metamaterial structures that are useful in accordance with the principles of the present invention in the antenna structure of FIG. 1. The metamaterials of FIGS. 4A and 4B are illustratively of the type investigated by Christophe Caloz et al. of the University of California, Los Angeles, Department of Electrical Engineering. Examples of the principles underlying such metamaterials can be found in *Microwave Circuits Based on Negative Regractince Index Material Structures*, Caloz et al., 33$^{rd}$ European Microwave Conference, conference report, p. 105, Munich, Germany 2003; *Positive/Negative Refractice Index Anisotropic 2-D Metamaterials*, Caloz et al, IEEE Microwave and Wireless Components Letters, Vol. 13, No. 12, p. 547, December 2003; *Invited—Novel Microwave Devices and Structures Based on the Transmission Line Approach of Meta-Materials*, Caloz et al., 2003 IEEE MTT-S Digest, p. 195; *A Broadband Left-Handed (LH) Coupled-Line Backward Coupler with Arbitrary Coupling Level*, Caloz et al., 2003 IEEE MTT-S Digest, p. 317; and *A Novel Mixed Conventional MIcrostrip and Composite Right Left-Handed Backward-Wave Directional Coupler With Broadband and Tight Coupling Characteristics*, Caloz et. al., IEEE Microwave and Wireless Components Letters, Vol. 14, No. 1, January 2004, p. 31. Each of the foregoing publications are hereby incorporated by reference herein in their entirety.

Referring to FIG. 4A, structure 400 is an illustrative microstrip line 401 developed by Caloz et al., wherein a plurality of unit-cell circuit structures are repeated periodically along the microstrip line. A unit-cell circuit structure merely is one or more electrical components, in this case disposed along the microstrip transmission line. In FIG. 4A, for example, series interdigital capacitors 402 are placed periodically along the line 401 and T-junctions 403 between each of the capacitors 402 connect the microstrip line 401 to shorted spiral stub delay lines 404 that are, in turn, connected to ground by vias 405. The microstrip structure of one of the aforementioned capacitors, one spiral inductor, and the associated ground via, forms the unit-cell circuit structure of FIG. 4A. By using a plurality of microstrip lines in place of the delay lines 107 in FIG. 1, the phases of the signals traveling along the edges of the lens are delayed relative to those traveling in the center of the lens. Thus, the amplitude of the center portion of the beam transmitted by antenna 101 is higher than the amplitude at the edges and, accordingly, sidelobes are reduced. One skilled in the art will recognize that other suitable unit-cell circuit architectures may be used to achieve the propagation characteristics useful in accordance with the principles of the present invention. For example, FIG. 4B shows a 3 dimensional representation of a microstrip metamaterial structure that does not rely on spiral inductors.

Caloz reported in the publication *Invited—Novel Microwave Devices and Structures Based on the Transmission Line Approach of Meta-Materials* referenced above, that structures similar to FIG. 4A could be used in leaky wave antennas (not phased array antennas) that were designed to operate at frequencies up to approximately 6.0 GHz. The present inventors, however, have realized that, with certain modifications, these metamaterials can be used at relatively high frequencies, such as those frequencies useful in automotive radar and/or data communications applications above 60 GHz and, more particularly, between 76 GHz and 77 GHz (for automotive radar) and 71–76 and 81–86 GHz (for data communications). For example, the unit cell-circuit structure of FIG. 4A can be reduced to a size smaller than the wavelength of the signal. It is obvious to one skilled in the art, in light of the teachings herein, how to design the metamaterial microstrip line (e.g., physical size and positioning of unit cells) to achieve a desired transmission line impedance at a particular frequency.

One problem with using the above-described metamaterial structures in high-frequency applications is that such high-frequency signals traveling across microstrip lines experience a high degree of attenuation. Specifically, as frequencies rise to $\geqq$70 GHz, signal attenuation for a given traditionally-designed transmission line length increases significantly and, accordingly, the received signal strength at a signal's destination is significantly reduced. Thus, traditional microstrip transmission lines are inadequate for use at such high frequencies. Such signal attenuation and methods for reducing the attenuation is the subject of copending U.S. patent application Ser. No. 10/788,826, entitled Low-Loss Transmission Line Structure, filed Feb. 27, 2004. This patent application is hereby incorporated by reference herein in its entirety.

Figure 5:
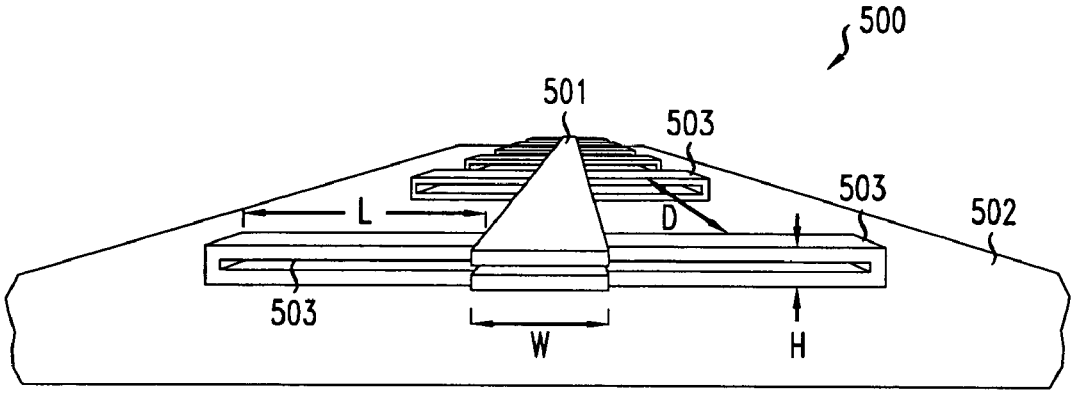
FIG. 5 shows a suspended transmission line.

As discussed more fully in the 10/788,826 application, FIG. 5 shows one illustrative embodiment of a transmission line structure 500 in accordance with the principles of the present invention whereby the aforementioned dielectric signal loss is reduced or substantially eliminated. Specifically, FIG. 5 shows an illustrative transmission line 501 that is physically suspended above substrate 502 which is, illustratively, a metallized layer functioning as an electrical ground for transmission line 501. Transmission line 501 is also referred to herein interchangeably as a transmission element. One skilled in the art will recognize that substrate 502 may be, for example, a layer of gold, copper, aluminum, or another electrically conducting material suitable for use as a ground plane. Support elements 503, here illustratively bent support arms, are attached to both the transmission line and the substrate and function to both support the transmission line above the ground substrate 502 as well as, illustratively, to electrically connect the transmission line to that substrate. Once again, support arms 503 may be, illustratively, manufactured from an electrically conducting material such as the aforementioned gold, copper or aluminum or any other electrically conducting material. One skilled in the art will recognize that other materials, such as plastic may be used to support the transmission element. Support arms 503 have length L and height H and are spaced a distance D from each other. One skilled in the art will recognize that L, D and H can be selected to produce a desired electrical property of transmission element 501, such as the impedance of the transmission line. For example, if the line width W is selected as 1.08 mm, the length L of the support arms is selected as 3.01 mm, the height H is selected as 250 micrometers, and the support arms are separated by 4 mm from each other, transmission line 501 will illustratively have approximately a 50 Ohm impedance, which is desirable in a number of applications. Other dimensions may be selected to produce a variety of desirable transmission line impedances. The transmission line structure 500 of FIG. 5 substantially reduces the signal attenuation of a high-frequency RF signal propagating along transmission line 201. This reduction is the result of separating the transmission line from the substrate and, accordingly, reducing the exposure of the propagating signal to any electromagnetic field present in the substrate. One skilled in the art will fully recognize that, by applying the above-described method to suspend a transmission line above the associated ground plane, attenuation in the metamaterial structures of FIGS. 4A and 4B can be significantly reduced or eliminated.

The foregoing merely illustrates the principles of the invention. It will thus be appreciated that those skilled in the art will be able to devise various arrangements which, although not explicitly described or shown herein, embody the principles of the invention and are within its spirit and scope. Furthermore, all examples and conditional language recited herein are intended expressly to be only for pedagogical purposes to aid the reader in understanding the principles of the invention and are to be construed as being without limitation to such specifically recited examples and conditions. Moreover, all statements herein reciting aspects and embodiments of the invention, as well as specific examples thereof, are intended to encompass functional equivalents thereof.

What is claimed is:

1. A phased-array antenna system for transmitting at least a first electromagnetic signal, said system comprising:

a phased-array antenna having a plurality of elements, wherein said plurality of elements is arranged in an array, each of said elements in said plurality adapted to radiate electromagnetic energy to form said electromagnetic signal; and a biconcave electromagnetic lens for inputting electromagnetic signals to at least a portion of said elements;

wherein at least a portion of said electromagnetic lens comprises a metamaterial.

2. The phased-array antenna system of claim 1 wherein said metamaterial comprises a plurality of periodic unit-cells disposed along at least a first microstrip line.

3. The phased-array antenna system of claim 2 wherein said periodic unit-cells comprise a plurality of electrical components.

4. The phased-array antenna system of claim 3 wherein at least a portion of said plurality of electrical components comprise capacitors.

5. The phased array antenna system of claim 3 wherein at least a portion of said plurality of electrical components comprise inductors.

6. The phased array antenna system of claim 3 wherein at least a portion of said plurality of electrical components comprise distributed circuit components.

7. The phased-array antenna system of claim 1 wherein said metamaterial comprises a plurality of microstrip lines, each of said microstrip lines further comprising a plurality of periodic unit-cells.

8. The phased-array antenna system of claim 7 wherein said periodic unit-cells comprise a plurality of electrical components.

9. The phased-array antenna system of claim 8 wherein at least a portion of said plurality of electrical components comprise capacitors.

10. The phased array antenna system of claim 8 wherein at least a portion of said plurality of electrical components comprise inductors.

11. The phased array antenna system of claim 1 wherein said metamaterial comprises:

a conducting transmission element;

a substrate comprising at least a first ground plane for grounding said transmission element;

a plurality of unit-cell circuits disposed periodically along said transmission element;

at least a first via for electrically connecting said transmission element to said at least a first ground plane; and means for suspending said conducting transmission element a first distance away from said substrate in a way such that said transmission element is located at a second predetermined distance away from said ground plane.

* * * * *